US011384672B2

(12) United States Patent
Hatanaka

(10) Patent No.: US 11,384,672 B2
(45) Date of Patent: Jul. 12, 2022

(54) SECONDARY AIR INTRODUCTION DEVICE

(71) Applicant: KAWASAKI JUKOGYO KABUSHIKI KAISHA, Kobe (JP)

(72) Inventor: Tatsuya Hatanaka, Kobe (JP)

(73) Assignee: KAWASAKI MOTORS, LTD.

( * ) Notice: Subject to any disclaimer, the term of this patent is extended or adjusted under 35 U.S.C. 154(b) by 0 days.

(21) Appl. No.: 17/467,782

(22) Filed: Sep. 7, 2021

(65) Prior Publication Data

US 2022/0112829 A1 Apr. 14, 2022

(30) Foreign Application Priority Data

Oct. 9, 2020 (JP) ..... JP2020-171037

(51) Int. Cl.

| | |
|---|---|
| ***F01N 3/30*** | (2006.01) |
| *F01N 13/08* | (2010.01) |
| *F01N 3/22* | (2006.01) |

(52) U.S. Cl.

CPC ..... *F01N 3/30* (2013.01); *F01N 3/222* (2013.01); *F01N 13/08* (2013.01); *F01N 2270/04* (2013.01); *F01N 2590/04* (2013.01)

(58) Field of Classification Search

CPC ..... F01N 3/30; F01N 2270/04; F01N 2590/04
See application file for complete search history.

(56) References Cited

U.S. PATENT DOCUMENTS

| | | | | |
|---|---|---|---|---|
| 6,192,865 | B1 * | 2/2001 | Hori | F02F 1/38 123/470 |
| 7,757,479 | B2 * | 7/2010 | Hirayama | F01N 3/303 60/289 |
| 2008/0178584 | A1 * | 7/2008 | Kuji | F01N 3/30 60/317 |

FOREIGN PATENT DOCUMENTS

| | | | |
|---|---|---|---|
| JP | H04287783 | A * | 10/1992 |
| JP | 10-030434 | | 3/1998 |
| JP | 3284893 | B2 * | 5/2002 |
| JP | 2003120278 | A * | 4/2003 |

OTHER PUBLICATIONS

Machine translation of JP-2003120278-A, accessed Dec. 14, 2021. (Year: 2021).*

* cited by examiner

*Primary Examiner* — Jonathan R Matthias

(57) ABSTRACT

A secondary air introduction device is configured to supply air into an exhaust passage of an engine to combust unburned gas contained in exhaust gas. The secondary air introduction device includes: an air introduction passage configured to introduce air into the exhaust passage; and a secondary air valve configured to be attached to an outer surface of a cylinder head of the engine and to control opening and closing of the air introduction passage. The secondary air valve is configured to be attached to an outer lateral surface of the cylinder head on one side in an axial direction of a crankshaft, and the secondary air valve includes an air introduction inlet formed in a position opposite to the outer lateral surface of the cylinder head in the axial direction of the crankshaft.

8 Claims, 6 Drawing Sheets

SECONDARY AIR INTRODUCTION DEVICE

CROSS REFERENCE TO THE RELATED APPLICATION

This application is based on and claims Convention priority to Japanese patent application No. 2020-171037, filed Oct. 9, 2020, the entire disclosure of which is herein incorporated by reference as a part of this application.

BACKGROUND OF THE INVENTION

Field of the Invention

The present invention relates to a secondary air introduction device configured to supply air into an exhaust passage of an engine to combust unburned gas contained in exhaust gas.

Description of Related Art

Some engines used as a drive source in a vehicle such as a motorcycle have been known in which a secondary air introduction device is disposed in an exhaust passage thereof (for example, JP Laid-open Patent Publication No. H10-030434). The secondary air introduction device includes a secondary air valve configured to open and close an air introduction passage for introducing air into the exhaust passage. In JP Laid-open Patent Publication No. H10-030434, the secondary air valve is attached to a vehicle body frame.

In the structure of the JP Laid-open Patent Publication No. H10-030434, the secondary air valve is attached to the vehicle body frame. Accordingly, the secondary air valve is likely to undergo a large displacement with respect to the engine. For this reason, it is necessary to provide a rubber mount to support the secondary air valve or to constitute a part of a pipe connecting the secondary air valve with the exhaust passage by a rubber tube in order to suppress vibration.

SUMMARY OF THE INVENTION

An object of the present invention is to provide a secondary air introduction device capable of suppressing relative vibration between a secondary air valve and a cylinder head.

In order to achieve the above object, the present invention provides a secondary air introduction device configured to supply air into an exhaust passage of an engine to combust unburned gas contained in exhaust gas, the secondary air introduction device including: an air introduction passage configured to introduce air into the exhaust passage; and a secondary air valve configured to be attached to a cylinder head of the engine and to control opening and closing of the air introduction passage. The secondary air valve is configured to be attached to an outer lateral surface of the cylinder head on one side in an axial direction of a crankshaft, and the secondary air valve includes an air introduction inlet formed in a position opposite to the outer lateral surface of the cylinder head in the axial direction of the crankshaft. For example, the position, in which the air introduction inlet is formed in the secondary air valve, overlaps with the cylinder head when viewed in the axial direction of the crankshaft.

According to this constitution, the secondary air valve is attached to the cylinder head, and therefore, relative vibration between the secondary air valve and the cylinder head can be suppressed. This offers a greater freedom in a support structure for the secondary air valve and in material selection for a pipe connecting the secondary air valve with the exhaust passage. Further, the secondary air valve is formed with the air introduction inlet in the position opposite to the outer lateral surface of the cylinder head, and therefore, it is possible to prevent interference between intake and exhaust pipes and pipes connected to the secondary air valve and thus to easily arrange the secondary air valve on the cylinder head.

In the present invention, the secondary air valve may include an elastic valve body having a plate shape, and the secondary air valve may be arranged such that a thickness direction of the valve body corresponds to the axial direction of the crankshaft. According to this constitution, the secondary air valve protrudes less with respect to the cylinder head in the axial direction of the crankshaft, which makes it easy to dispose the secondary air valve on the outer lateral surface of the cylinder head.

In the present invention, the secondary air valve may be disposed on one side in the axial direction of the crankshaft with respect to a power transmission member configured to transmit power to a valve mechanism of the engine, and an exhaust port may be provided on the other side with respect to the power transmission member. According to this constitution, the secondary air valve is disposed away, in the axial direction of the crankshaft, from the exhaust port by a space occupied by the power transmission member. Thus, heat transfer from the exhaust port to the secondary air valve can be mitigated, and therefore, influence of exhaust heat can be suppressed.

In the present invention, an exhaust pipe of the engine may extend on the other side of the cylinder head in the axial direction of the crankshaft. According to this constitution, the secondary air valve is disposed in an area opposite to the exhaust pipe with the cylinder head interposed therebetween. Thus, the secondary air valve can be disposed at a position distant from the exhaust pipe. Therefore, heat transfer from the exhaust pipe to the secondary air valve can be mitigated, and therefore, influence of exhaust heat can be suppressed.

In the present invention, the secondary air valve may be configured to be attached to the cylinder head through a plug member configured to close a passage defined inside the cylinder head. This constitution eliminates the necessity of providing a dedicated structure for attaching the secondary air valve to the cylinder head.

In the present invention, a pipe constituting a downstream part of the air introduction passage and connecting the secondary air valve with the exhaust passage may be made of a metal material. According to this constitution, the pipe of the downstream part of the air introduction passage can have improved heat resistance. Since the secondary air valve and the exhaust passage (cylinder head) constitute a same vibration system as described above, it is possible prevent the pipe of the downstream part connecting these components from having greater vibration, or a larger amplitude of vibration. Thus, even where the pipe of the downstream part is made of a metal material having excellent heat resistance, it is possible to suppress stress occurring in the pipe support part.

In the present invention, a pipe constituting a downstream part of the air introduction passage and connecting the secondary air valve with the exhaust passage may extend in the axial direction of the crankshaft in an area lower than a top part of a cylinder head cover. This constitution makes it easy to ensure a clearance between the pipe and a component disposed above the cylinder head cover and thus to avoid interference between the air introduction passage and other components.

In the present invention, the secondary air introduction device may further include a bracket configured to attach the secondary air valve to the cylinder head, wherein the bracket may include a support part configured to support a pipe constituting an upstream part of the air introduction passage, the upstream part being located on an upper side with respect to the secondary air valve. According to this constitution, the bracket for attaching the secondary air valve also serves to support the pipe, and therefore, the number of components can be reduced.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

The present invention will be more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views:

DESCRIPTION OF THE EMBODIMENTS

Figure 1:
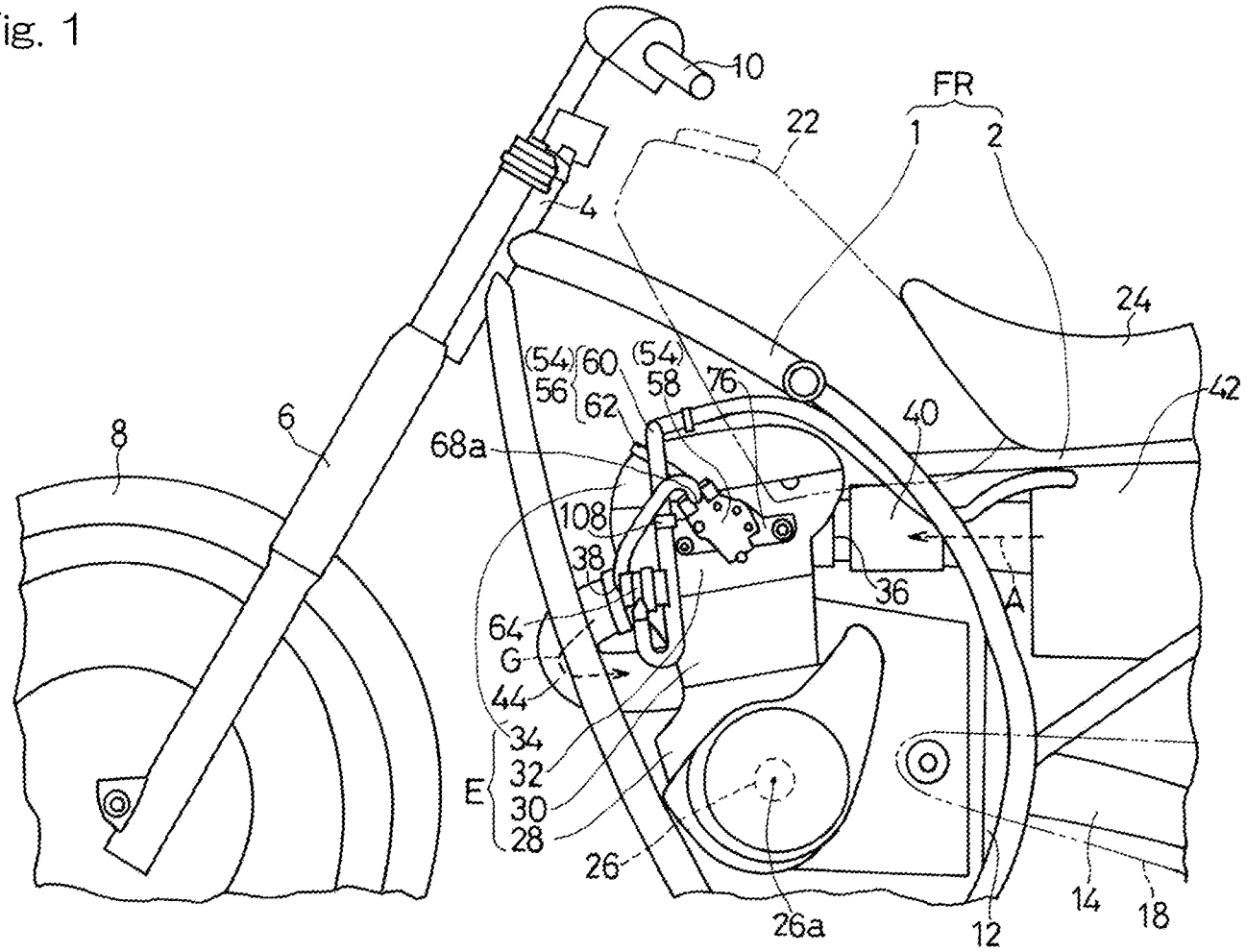
FIG. 1 is a side view illustrating a front part of a motorcycle including an engine including a secondary air introduction device according to a first embodiment of the present invention.

Hereinafter, a preferred embodiment of the present invention will be described with reference to the drawings. FIG. 1 is a side view illustrating a front part of a motorcycle including an engine including a secondary air introduction device according to a first embodiment of the present invention. In the present specification, the "left" and "right" sides correspond to the "left" and "right" sides as seen by a rider on a vehicle, respectively. The "front" and "rear" sides correspond to the "front" and "rear" sides with respect to a direction in which the vehicle moves, respectively. Further, the "upstream" and "downstream" sides correspond to the "upstream" and "downstream" sides with respect to a direction in which air flows, respectively.

A vehicle body frame FR of the motorcycle in the present embodiment includes a main frame 1 constituting a front half of the vehicle body frame FR and a rear frame 2 constituting a rear half of the vehicle body frame FR. The rear frame 2 is coupled to a rear part of the main frame 1.

A front fork 6 is turnably supported by a head pipe 4 disposed at front end of the main frame 1 through a steering shaft (non-illustrated). A front wheel 8 is mounted to a lower end of the front fork 6. A handlebar 10 is mounted to an upper end portion of the front fork 6.

A swing arm bracket 12 is provided to a rear end portion of the main frame 1. The swing arm bracket 12 supports a swing arm 14 in a vertically swingable manner. A rear wheel (not illustrated) is mounted to a rear end portion of the swing arm 14.

An engine E, which is a drive source of the motorcycle, is mounted in a lower part of the main frame 1 and in front of the swing arm bracket 12. The engine E is configured to drive the rear wheel through a power transmission member 18 such as a chain. A fuel tank 22 is disposed in an upper part of the main frame 1, and a seat 24 for a rider is mounted on the rear frame 2.

The engine E in the present embodiment is a water-cooled single-cylinder engine. However, the engine is not limited to this type and may be an air-cooled engine or a multi-cylinder engine. The engine E includes: a crankcase 28 for rotatably supporting a crankshaft 26; a cylinder 30 protruding upward from the crankcase 28; a cylinder head 32 coupled to an upper part of the cylinder 30; and a cylinder head cover 34 attached to an upper part of the cylinder head 32. The engine E is supported by the vehicle body frame FR and is disposed between the front wheel 8 and the rear wheel (not illustrated). In the present embodiment, the engine E is disposed between the head pipe 4 and the seat 24 in a front to rear (front-rear) direction or longitudinal direction of the motorcycle.

In the present embodiment, an axis 26*a* of the crankshaft 26 extends in a vehicle widthwise direction (a left to right direction) of the motorcycle. In the following description, a left side of the vehicle body is called as one side in an axial direction of the crankshaft 26, and a right side of the vehicle body is called as the other side in the axial direction of the crankshaft 26. A side stand (not illustrated) is provided on the left side of the vehicle (on the one side in the axial direction of the crankshaft 26).

The cylinder head 32 has a rear surface formed with an air intake port 36 and a front surface formed with an exhaust port 38. A fuel supply device 40 is connected to the air intake port 36, and an air cleaner 42 is connected to the fuel supply device 40. The air cleaner 42 is configured to filter outside air to generate clean air. The fuel supply device 40 is configured to inject fuel into the clean air from the air cleaner 42 to generate air-fuel mixture and supply the mixture to the air intake port 36. The fuel supply device 40 may be, for example, a throttle body or a carburetor with a fuel injection valve.

An exhaust pipe 44 is connected to the exhaust port 38. The exhaust pipe 44 extends frontward from a front surface of the cylinder head 32, then is curved rearward in a U-shaped manner, and then extends rearward on the right side of the cylinder head 32 to be connected to an exhaust muffler (not illustrated). A part of the exhaust pipe 44, which extends on the right side of the cylinder head 32 (on the other side in the axial direction of the crankshaft 26), extends in an area above the axis 26*a* of the crankshaft 26 of the engine E and below an upper end of the cylinder head 32.

Figure 4:
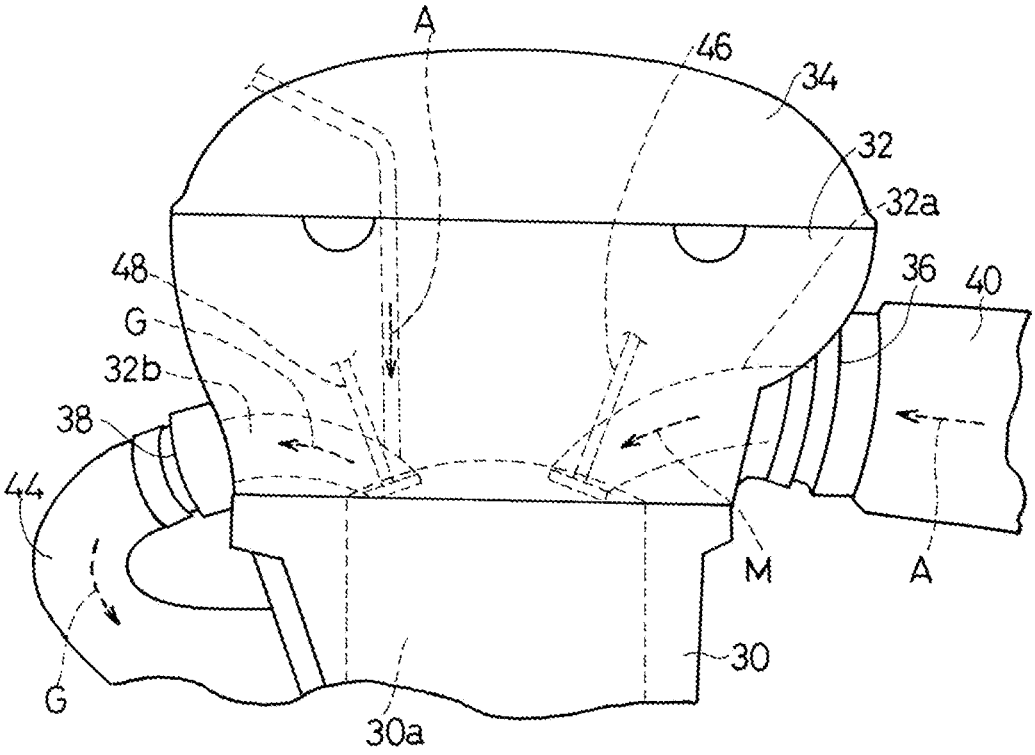
FIG. 4 is a side view of the engine, with the secondary air introduction device being removed.

As shown in FIG. 4, a combustion chamber 30*a* is defined inside the cylinder 30, and an intake passage 32*a* and an exhaust passage 32*b* are defined inside the cylinder head 32. The intake passage 32*a* connects the air intake port 36 with the combustion chamber 30*a*, and the exhaust passage 32*b* connects the combustion chamber 30*a* with the exhaust port 38. That is, the mixture is introduced to the combustion chamber 30*a* through the intake passage 32*a*, and exhaust gas is discharged from the combustion chamber 30*a* through the exhaust passage 32*b*.

An outlet of the intake passage 32*a* is opened and closed by an intake valve 46, and an inlet of the exhaust passage 32*b* is opened and closed by an exhaust valve 48. The cylinder head 32 is provided with a valve mechanism (not illustrated) configured to control the intake valve 46 and the exhaust valve 48. The valve mechanism is a known component and may be constituted by, for example, a camshaft and a cam disposed therein.

Figure 5:
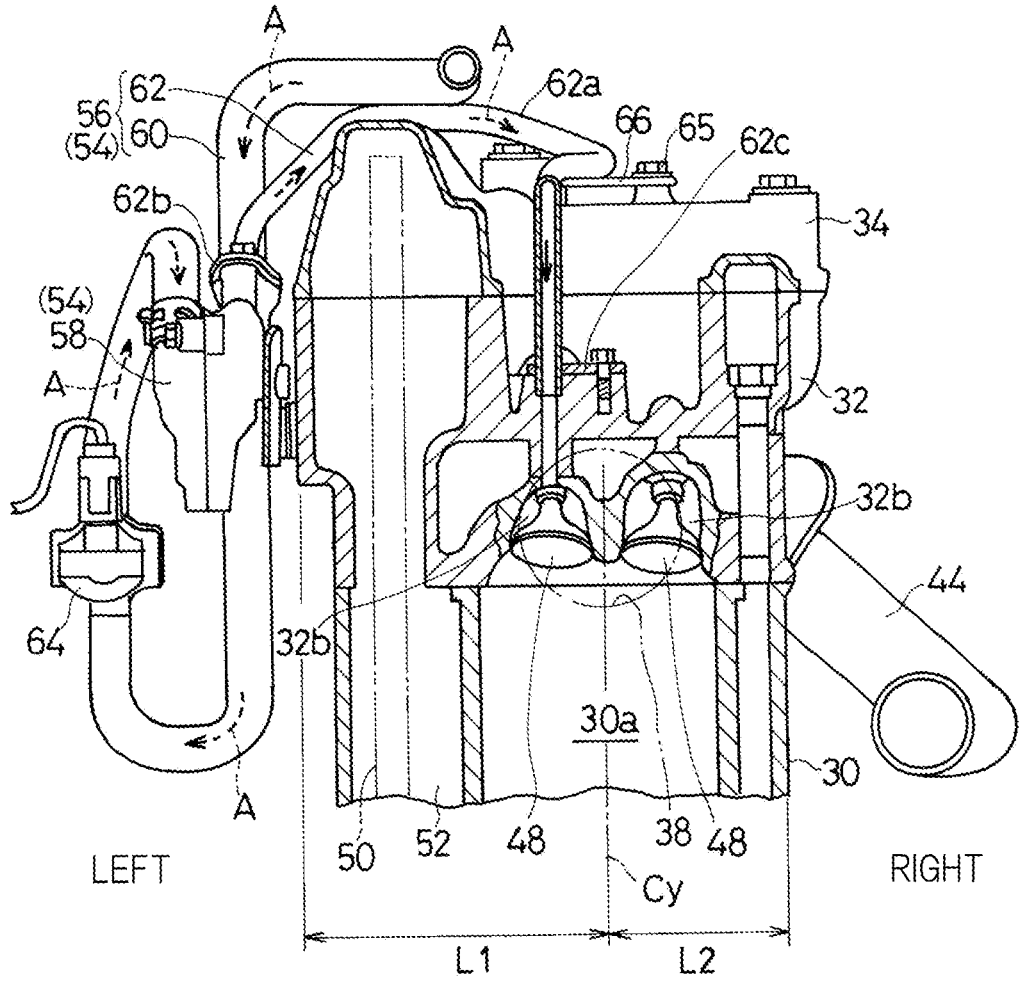
FIG. 5 is a vertical section view of the engine along a plane parallel to a widthwise direction of the motorcycle.

The valve mechanism is configured to be driven by power of the crankshaft 26 (FIG. 1) of the engine E. Specifically, the power of the crankshaft 26 (FIG. 1) is transmitted to the valve mechanism by a power transmission member 50 as shown in FIG. 5. Examples of the power transmission member 50 may include a belt and a chain etc. The power transmission member 50 is disposed on the one side in the axial direction of the crankshaft 26 of the engine E (i.e., on the left side of the engine E in the present embodiment). More specifically, the power transmission member 50 is disposed in a housing space 52 provided on the left side with respect to the combustion chamber 30*a*, the intake passage 32*a* (FIG. 4) and the exhaust passage 32*b* of the engine E. That is, the cylinder head 32 has an axial distance L1 from a cylinder axis CY to a left-side surface (i.e., a surface on the one side in the axial direction of the crankshaft 26) of the cylinder head, which is larger than an axial distance L2 from the cylinder axis CY to a right-side surface (i.e., a surface on the other side in the axial direction of the crankshaft 26) of the cylinder head by a space occupied by the housing space 52 formed therein.

The engine E is provided with a secondary air introduction device 54. The secondary air introduction device 54 is configured to supply the air from the air cleaner 42 into the exhaust passage 32*b* and to combust unburned gas contained in the exhaust gas. As shown in FIG. 1, the secondary air introduction device 54 includes: an air introduction passage 56 for introducing the air into the exhaust passage 32*b*; and a secondary air valve 58 for controlling opening and closing of the air introduction passage 56.

The secondary air valve 58 allows the air to flow only in a single direction. In the present embodiment, a reed valve is used as the secondary air valve 58. However, the secondary air valve 58 is not limited to a reed valve. The secondary air valve 58 is attached to the outer lateral surface of the cylinder head 32 on the one side in the axial direction of the crankshaft 26 and is disposed on an outside of the cylinder head 32. In the present embodiment, the entirety of the secondary air valve 58 overlaps with the cylinder head 32 when viewed in the axial direction of the crankshaft 26. In the present embodiment, the secondary air valve 58 is disposed at a center part of the outer lateral surface of the cylinder head 32 in the front-rear direction.

Specifically, the secondary air valve 58 is disposed between an intake camshaft and an exhaust camshaft in the front-rear direction. In other words, the secondary air valve 58 is disposed in an area between the intake valve 46 and the exhaust valve 48.

Specifically, as shown in FIG. 5, the secondary air valve 58 is attached to a lateral surface opposite to the exhaust port 38 (FIG. 4) with the housing space 52 located therebetween. That is, the secondary air valve 58 is disposed on the one side in the axial direction of the crankshaft 26 (on the left side in the present embodiment) with respect to the power transmission member 50 of the engine E, and the exhaust port 38 is provided on the other side (on the right side in the present embodiment) with respect to the power transmission member 50. The secondary air valve 58 is attached to a lateral surface, of the outer lateral surface of the cylinder head 32, located opposite to the exhaust pipe 44. That is, in the present embodiment, the secondary air valve 58 is attached to a left-side surface of the cylinder head 32. The secondary air valve 58 will be described in terms of details of its features and a support structure therefor.

As shown in FIG. 1, the air introduction passage 56 includes: an upstream part 60 connecting the secondary air valve 58 with the air cleaner 42; and a downstream part 62 connecting the secondary air valve 58 with the exhaust passage 32*b* (FIG. 5). The upstream part 60 of the air introduction passage 56 extends rearward above the cylinder head cover 34 along the main frame 1 and is connected to the air cleaner 44.

Figure 2:
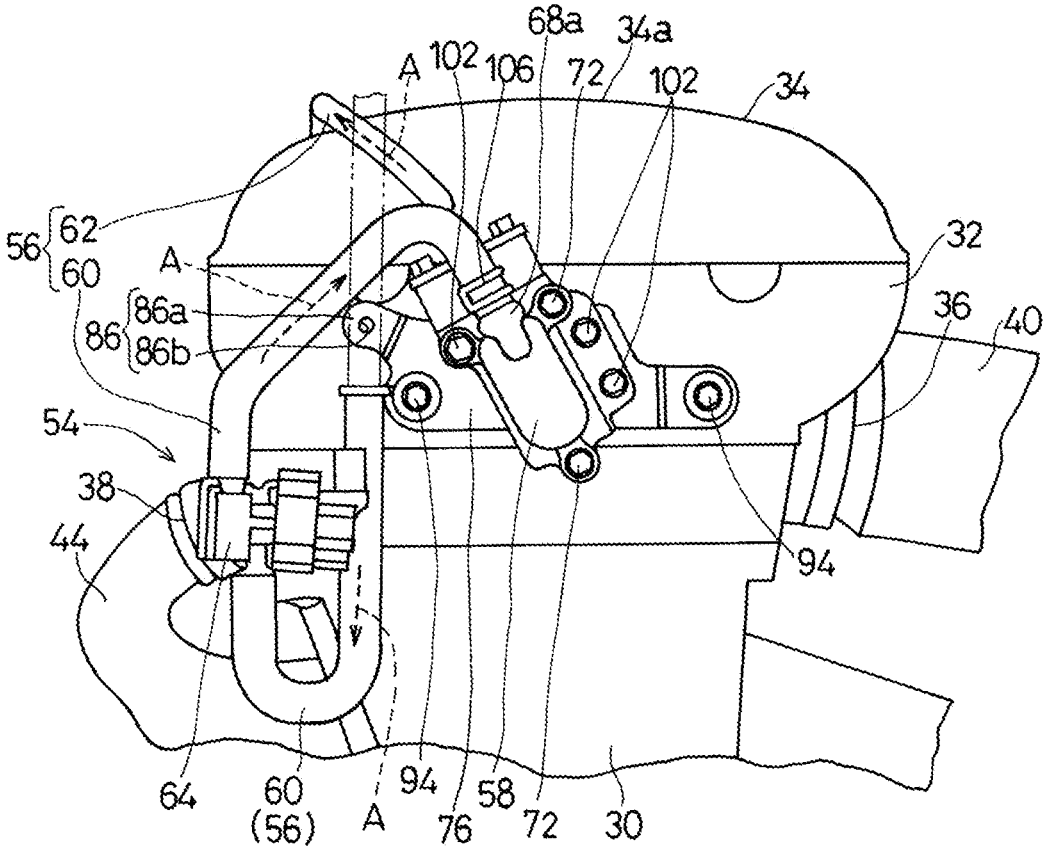
FIG. 2 is a side view of the engine.

The upstream part 60 of the air introduction passage 56 is constituted by, for example, a rubber tube. As shown in FIG. 2, the upstream part 60 of the air introduction passage 56 is provided with an adjustment valve 64. The adjustment valve 64 is configured to adjust a timing for supplying the secondary air. For example, the adjustment valve may be an electromagnetic valve. The adjustment valve 64 is controlled by e.g. an electronic control unit (ECU). In the present embodiment, the adjustment valve 64 is disposed at a lower front position with respect to the secondary air valve 58 on the left side of the cylinder 30. However, the position of the adjustment valve 64 is not limited to this position. The adjustment valve 64 may be omitted.

Figure 3:
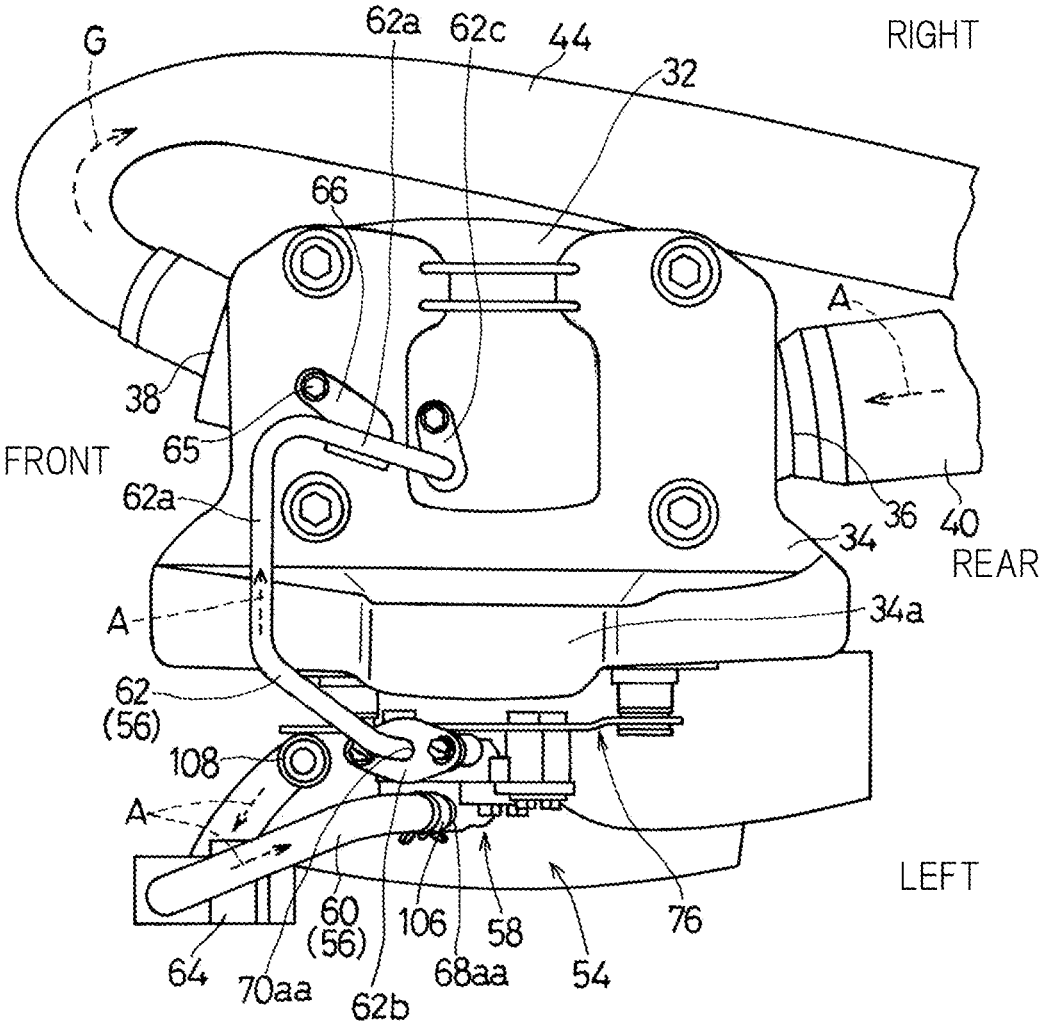
FIG. 3 is a plan view of the engine.

The downstream part 62 of the air introduction passage 56 is constituted by a pipe made of a metal material. In the present embodiment, the downstream part 62 of the air introduction passage 56 is constituted by a steel pipe. The downstream part 62 of the air introduction passage 56 extends upward from the secondary air valve 58 and then extends above the cylinder head cover 34 in the axial direction of the crankshaft 26 (i.e., in the vehicle widthwise direction) as shown in FIG. 3. The downstream part 62 of the air introduction passage 56 then extends obliquely rearward and downward over the cylinder head cover 34 and is connected to the exhaust passage 32*b* of the cylinder head 32.

As shown in FIG. 2, the downstream part 62 of the air introduction passage 56 extends upward so as to be inclined obliquely forward. The downstream part 62 of the air introduction passage 56 then extends in an area lower than a top part 34*a* of the cylinder head cover 34 in the axial direction of the crankshaft 26 (i.e., in the vehicle widthwise direction). In other words, the downstream part 62 of the air introduction passage 56 extends upward and obliquely forward so as to avoid passing the top part 34*a* of the cylinder head cover 34. As described above, the secondary air valve 58 is disposed obliquely, and therefore, the pipe extending upward and obliquely forward can be arranged so as to take a shortest path.

As shown in FIG. 3, the downstream part 62 of the air introduction passage 56 according to the present embodiment includes: a tube body 62*a* constituted by a steel tube; and flanges 62*b*, 62*c* provided on opposite ends of the tube body 62*a*. The tube body 62*a* and the flanges 62*b*, 62*c* are jointed by e.g. welding.

An upstream end of the downstream part 62 of the air introduction passage 56 is bolted to the secondary air valve 58 through the flange 62*b*, and a downstream end of the downstream part 62 of the air introduction passage 56 is bolted to the cylinder head 32 through the flange 62*c*. Further, a middle part of the tube body 62*a* of the downstream part 62 of the air introduction passage 56 is supported by the cylinder head cover 34. Specifically, the middle part of the tube body 62*a* is provided with a support stay 66 fixed thereto by welding and is attached to the cylinder head cover 34 by a bolt 65 through the support stay 66.

Thus, the downstream part 62 of the air introduction passage 56 is supported at the opposite ends and the middle part thereof, so that the downstream part 62 of the air introduction passage 56 is stably supported. However, the support structure for the downstream part 62 of the air introduction passage 56 is not limited to this configuration.

Figure 6:
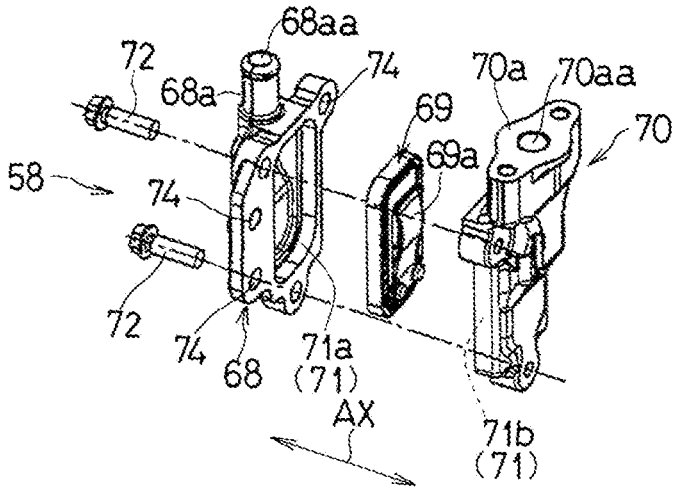
FIG. 6 is an exploded view of a secondary air valve of the secondary air introduction device.

As shown in FIG. 6, the secondary air valve 58 includes a first casing 68, a second casing 70, and a valve member 69, and the first and second casings 68, 70 are coupled to each other by a bolt 72 with the valve member 69 interposed therebetween. The first casing 68 has an air inlet part 68*a* formed at an upper part of the first casing 68, and the second casing 70 has an air outlet part 70*a* formed at an upper part of the second casing 70. The air inlet part 68*a* is formed with an air introduction inlet 68*aa* for supplying the air to the secondary air valve 58. The air outlet part 70*a* is formed with an air introduction outlet 70*aa* for discharging the air from the secondary air valve 58. In the present embodiment, the air inlet part 68*a* is constituted by a plug pin, and the air outlet part 70*a* is constituted by a flange.

The valve member 69 is a reed valve and includes a valve body 69*a* constituted by a plate member capable of opening only in a single direction. A valve chamber 71 is defined inside the first casing 68 and the second casing 70 and is partitioned by a valve body 69*a* to define an upstream valve chamber 71*a* and a downstream valve chamber 71*b*. That is, the upstream valve chamber 71*a* is a space upstream of the valve body 69*a* in a direction of air flow, and the downstream valve chamber 71*b* is a space downstream of the valve body 69*a*. In the present embodiment, the upstream valve chamber 71*a* is defined by the first casing 68, and the downstream valve chamber 71*b* is defined by the second casing 70.

The first casing 68 is formed with a bolt insertion hole 74 opened in the vehicle widthwise direction. In the present embodiment, there are three bolt insertion holes 74. However, the number of the bolt insertion holes 74 may be larger than or smaller than three.

As shown in FIG. 2, the air inlet part 68*a* of the secondary air valve 58 is disposed so as to be opposite to the outer lateral surface of the cylinder head 32 in the axial direction of the crankshaft 26. In other words, the air inlet part 68*a* of the secondary air valve 58 overlaps with the cylinder head 32 when seen in a side view. As shown in FIG. 3, the air introduction inlet 68*aa* and the air introduction outlet 70*aa* are arranged in a same orientation. In the present embodiment, the air introduction inlet 68*aa* and the air introduction outlet 70*aa* are directed substantially upward. More specifically, the air introduction inlet 68*aa* and the air introduction outlet 70*aa* are opened upward and obliquely forward (toward the side of the exhaust port 38). Such an inclined arrangement makes it possible to stably support the secondary air valve 58 at a middle position on the outer lateral surface of the cylinder head 32 in the front-rear direction while reducing the bending of the downstream part 62 constituted by a metal pipe.

The air introduction inlet 68*aa* and the air introduction outlet 70*aa* are aligned in the axial direction of the crankshaft 26. In the present embodiment, the air introduction outlet 70*aa* is located closer to the cylinder head 32 than the air introduction inlet 68*aa*. This makes it possible to shorten the downstream part 62 constituted by a metal pipe and to dispose the upper pipe 60 constituted by a rubber hose away from the cylinder head 32. Further, as shown in FIG. 6, the valve body 69*a* of the secondary air valve 58 is disposed such that a thickness direction of the valve body 69*a* coincides with the axial direction AX of the crankshaft 26.

The support structure for the secondary air valve 58 will be described. As shown in FIG. 2, the secondary air valve 58 is attached to the outer lateral surface of the cylinder head 32 through a bracket 76. Specifically, the bracket 76 is removably attached to the cylinder head 32 by bolts 94, and then the secondary air valve 58 is removably attached to the bracket 76 by bolts 102.

Figure 7:
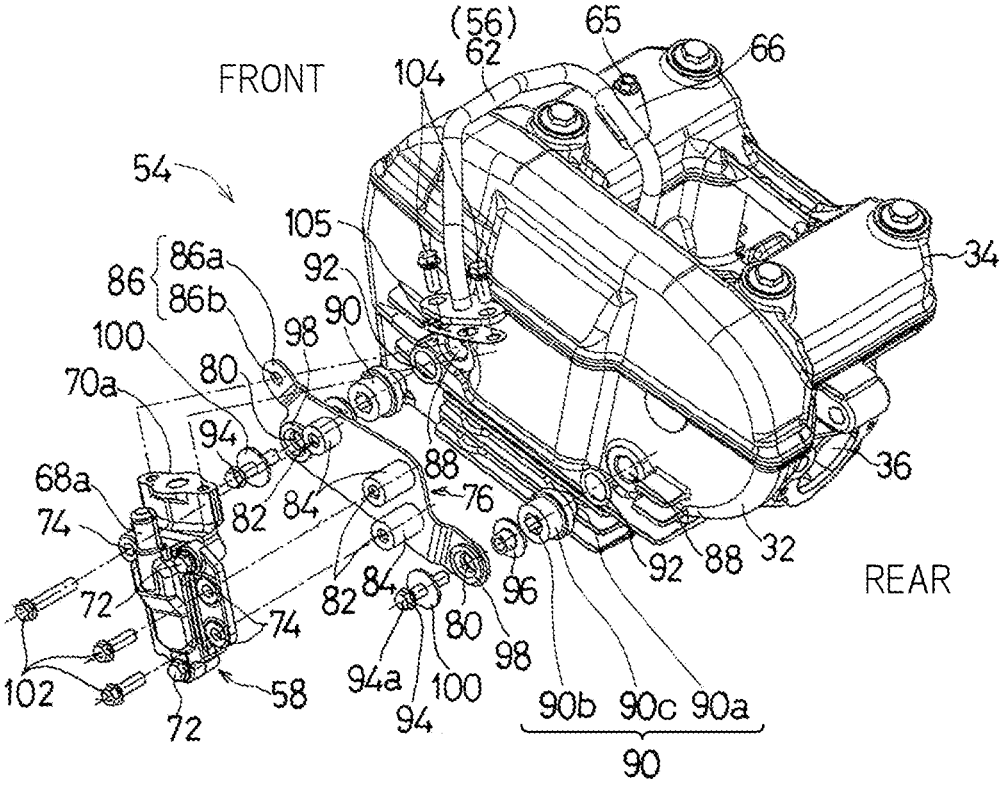
FIG. 7 is an exploded view of a support structure for the secondary air introduction device.

As shown in FIG. 7, the bracket 76 according to the present embodiment is formed by bending a metal plate member. The bracket 76 may be produced by any other method. The bracket 76 according to the present embodiment is shaped in an elongated form in the front-rear direction and is formed with bolt insertion holes 80 opened in the vehicle widthwise direction at opposite end portions of the bracket in the front-rear direction.

Further, the bracket 76 is formed with a threaded hole 82 opened in the vehicle widthwise direction at a position corresponding to that of the bolt insertion hole 74 of the secondary air valve 58. In the present embodiment, there are threaded holes 82 each constituted by a cylindrical boss 84 joined to the bracket 76. The constitution of the threaded hole 82 is not limited to the cylindrical boss 84.

The bracket 76 has a front end portion formed with a support part 86. The support part 86 supports the upstream part 60 of the air introduction passage 56 (FIG. 2). The support part 86 according to the present embodiment includes: a protruding piece 86*a* which protrudes frontward from the bracket 76; and a through-hole 86*b* defined in the protruding piece 86*a*. The constitution of the support part 86 is not limited to this structure. The support part 86 may be omitted.

The cylinder head 32 is formed with threaded holes 88 in the outer lateral surface of the cylinder head 32. There are two such threaded holes 88 aligned in the front-rear direction. In the present embodiment, the threaded holes 88 are constituted by plug holes for processing an oil passage in the cylinder head 34, and the plug holes are formed with female threads. The oil passage connects the intake valve 46 and the exhaust valve 48 with the housing space 52 and collects oil after valve lubrication in the housing space 52 (FIG. 5). Thus, use of the plug holes formed during the manufacturing process of the engine E makes it possible to reduce the number of components and the number of operation steps. However, the threaded holes 88 are not limited to the plug holes.

Plug members 90 are fitted to the threaded holes 88. The plug members 90 close a passage (the oil passage in the present embodiment) defined inside the cylinder head 32. The plug members 90 are removably attached to the threaded holes 88 through O rings 92. Each of the plug members 90 includes: a male thread part 90*a* configured to be fastened to the threaded hole 88; and a tubular boss part 90*c* having a female thread 90*b* formed thereinside. That is, the plug members 90 are fitted to the threaded holes 88 (plug holes) to close the oil passage and, at the same time, constitute mount parts for the secondary air valve 58.

The bracket 76 is removably attached to the female threads 90*b* of the plug members 90 by the bolts 94. Specifically, flanged collars 96 are inserted into the bolt insertion holes 80 of the bracket 76 from an inner side of the bracket in the vehicle widthwise direction, and the collars 96 are then inserted into tubular dampers 98 constituted by elastic members fitted into the bolt insertion holes 80. Then, the bolts 94 are inserted into hollow holes of the collars 96 from an outer side of the bracket in the vehicle widthwise direction and is fastened to the female threads 90*b* of the plug members 90. It should be noted that in the present embodiment, there are washers 100 interposed between heads 94*a* of the bolts 94 and the dampers 98.

Further, the secondary air valve 58 is removably attached to the bracket 76 by the bolts 102. Specifically, the bolts 102 are inserted into the bolt insertion holes 74 of the secondary air valve 58 from an outer side of the secondary air valve 58 in the vehicle widthwise direction and are fastened to the threaded holes 82 of the bracket 76. In this way, the secondary air valve 58 is attached to the cylinder head 32 through the bracket 76 and the plug members 90.

An upstream end of the downstream part 62 of the air introduction passage 56 is coupled to the air outlet part 70*a* (flange) of the secondary air valve 58 through the flange 62*b* by means of bolts 104. There is a gasket 105 interposed between the flange 62*b* and the air outlet part 70*a* of the secondary air valve 58. As described above, the secondary air valve 58 is attached to the cylinder head 32 through the dampers 98 constituted by the elastic members. Thus, even where the downstream part 62 of the air introduction passage 56 is constituted by a metal pipe as in the present embodiment, inclination of the pipe can be accommodated.

A downstream end of the upstream part 60 of the air introduction passage 56 as shown in FIG. 1 is coupled to the air inlet part 68*a* of the secondary air valve 58. Specifically, a rubber tube constituting the upstream part 60 is fitted to the air inlet part 68*a* (plug pin) of the secondary air valve 58 and is fastened by a cramp member 106 (FIG. 2) from its outer periphery so as to be retained.

The upstream part 60 of the air introduction passage 56 passes through the adjustment valve 64, extends upward on an outer side of the cylinder head 32 and the cylinder head cover 34 and then extends rearward to be connected to the air cleaner 42. The upwardly extending part of the upstream part 60 on the outer lateral side of the cylinder head 32 is supported by the support part 86 of the bracket 76. Specifically, a grip member 108 is attached to the through-hole 86*b* of the support part 86 of the bracket 76, and the grip member 108 supports the rubber tube constituting the upstream part 60.

The effects of the secondary air introduction device according to the present embodiment will be described. When the engine E as shown in FIG. 1 starts operating, the mixture M of fuel and air is supplied to the engine E from the air cleaner 42 through the fuel supply device 40. The mixture M is combusted in the combustion chamber 30*a* shown in FIG. 4, and exhaust gas G generated thereby is discharged from the exhaust port 38 to the outside of the engine through the exhaust passage 32*b*. The exhaust gas G discharged from the inside of the combustion chamber 30*a* into the exhaust passage 32*b* contains unburned gas.

At this point, the inside of the engine has negative pressure, and the valve body 69*a* (FIG. 6) of the secondary air valve 58 is open. Thus, when the adjustment valve 64 is opened in response to a command from the electronic control unit (ECU), air A (secondary air) from the air cleaner 42 is introduced into the exhaust passage 32*b* inside the cylinder head 32 shown in FIG. 4 through the air introduction passage 56. Thanks to the secondary air A, the unburned gas contained in the exhaust gas G is combusted, so that the contents of hydrocarbon (HC) and carbon monoxide (CO) in the exhaust gas are reduced.

According to the above constitution, the secondary air valve 58 shown in FIG. 1 is attached to the cylinder head 32, and therefore, relative vibration between the secondary air valve 58 and the cylinder head 32 can be suppressed. This offers a greater freedom in the support structure for the secondary air valve 58 and in material selection for the pipe (the upstream part 60 of the air introduction passage 56) connecting the secondary air valve 58 with the exhaust passage 32*b* (FIG. 4). Further, the air inlet part 68*a* of the secondary air valve 58 is formed in the position opposite to or away from the outer lateral surface of the cylinder head 32, and therefore, it is possible to prevent interference between pipes connected to the intake and exhaust ports 36, 38 (i.e., an intake pipe (the fuel supply device 40) and the exhaust pipe 44) and the pipes connected to the secondary air valve 58 (i.e., the upstream part 60 and the downstream part 62) and thus to easily arrange the secondary air valve 58 on the cylinder head 32.

Since the secondary air valve 58 is provided on the outer lateral surface of the cylinder head 32, a clearance between the engine E and a member disposed above the engine can be more easily ensured, as compared with a case where the secondary air valve is provided on an upper part of the cylinder head cover 34. The engine E of the present embodiment is a single-cylinder engine which has, for example, an ignition plug (not illustrated) on a right-side surface of the cylinder head 32 (a lateral surface opposite to the left-side surface where the secondary air valve 58 is attached). Thus, the secondary air valve 58 does not disturb incoming wind to be introduced into the area in the vicinity of the ignition plug.

Since the thickness direction of the valve body 69*a* of the secondary air valve 58 as shown in FIG. 6 coincides with the axial direction AX of the crankshaft 26, the secondary air valve 58 as shown in FIG. 3 protrudes less with respect to cylinder head 32 in the axial direction of the crankshaft 26, which makes it easy to dispose the secondary air valve 58 on the outer lateral surface of the cylinder head 32.

As shown in FIG. 5, the secondary air valve 58 is attached to the lateral surface opposite to the exhaust port 38 with the power transmission member 50 located therebetween. That is, the secondary air valve 58 is disposed on the left side of the power transmission member 50, and the exhaust port 38 is provided on the right side. Thus, the secondary air valve 58 is disposed away from the exhaust port 38 by the housing space 52 of the power transmission member 50. This makes it possible to suppress influence of heat of the exhaust gas from the exhaust port 38 on the secondary air valve 58.

The secondary air valve 58 is attached to the lateral surface opposite to the exhaust pipe 44 on the outer lateral surface of the cylinder head 32. That is, the secondary air valve 58 is disposed in an area on the left side of the cylinder head 32, and the exhaust pipe 44 is disposed in an area on the right side of the cylinder head 32. This makes it possible to suppress influence of heat from the exhaust pipe 44 on the secondary air valve 58.

As shown in FIG. 7, the secondary air valve 58 is attached to the cylinder head 32 through the plug members 90. This eliminates the necessity of providing a dedicated structure for attaching the secondary air valve 58 to the cylinder head 32, and therefore, the number of processing steps for the cylinder head 32 can be reduced.

The downstream part 62 connecting the secondary air valve 58 with the exhaust passage 32*b* (FIG. 4) in the air introduction passage 56 as shown in FIG. 2 is constituted by a metal pipe. Due to heat radiation from the engine E, the downstream part 62 of the air introduction passage 56 tends to have high temperature, so that the downstream part 62 is required to have improved heat resistance. By constituting the downstream part 62 by a metal pipe according to the above constitution, the downstream part 62 of the air introduction passage 56 can have improved heat resistance. In the present invention, since the secondary air valve 58 and the exhaust passage 32*b* (cylinder head 32) constitute a same vibration system, it is possible to prevent the pipe of the downstream part 62 connecting these components 58, 32 from having greater vibration, or a larger amplitude of vibration. Thus, even where the downstream part 62 is made of a metal material having excellent heat resistance, it is possible to suppress stress occurring in the pipe support part.

The downstream part 62 of the air introduction passage 56 extends in the vehicle widthwise direction in an area lower than the top part 34*a* of the cylinder head cover 34. This constitution makes it easy to ensure a clearance between the downstream part 62 and a component disposed above the cylinder head cover 34 and to avoid interference between the air introduction passage 56 and other components.

The secondary air valve 58 is attached to the cylinder head 32 through the bracket 76, and the bracket 76 is provided with the support part 86 for supporting the upstream part 60 of the air introduction passage 56. Thus, the bracket 76 for attaching the secondary air valve 58 also serves to support the pipe, and therefore, the number of components can be reduced.

The present invention is not limited to the above embodiments, and various additions, modifications, or deletions may be made without departing from the scope of the present invention. For example, although the above embodiments are described with reference to an example in which the secondary air introduction device according to the present invention is applied to a motorcycle, the secondary air introduction device according to the present invention may also be applied to engines of vehicles other than motorcycles. Further, the secondary air introduction device according to the present invention may also be applied to engines of vehicles other than wheeled vehicles as well as to stationary engines on the ground. Accordingly, such variants are included within the scope of the present invention.

REFERENCE NUMERALS

26 . . . crankshaft
32 . . . cylinder head
32*b* . . . exhaust passage
34 . . . cylinder head cover
38 . . . exhaust port
44 . . . exhaust pipe
50 . . . power transmission member
54 . . . secondary air introduction device
56 . . . air introduction passage
58 . . . secondary air valve
60 . . . upstream part
62 . . . downstream part
68*a* . . . air inlet part
69*a* . . . valve body
76 . . . bracket
86 . . . support part
90 . . . plug member
E . . . engine

What is claimed is:

1. A secondary air introduction device configured to supply air into an exhaust passage of an engine to combust unburned gas contained in exhaust gas, the secondary air introduction device comprising:

an air introduction passage configured to introduce air into the exhaust passage;

a secondary air valve configured to be attached to a cylinder head of the engine and to control opening and closing of the air introduction passage; and a bracket configured to attach the secondary air valve to the cylinder head, wherein the secondary air valve is configured to be attached to an outer lateral surface of the cylinder head on one side in an axial direction of a crankshaft, the secondary air valve includes an air introduction inlet formed in a position opposite to the outer lateral surface of the cylinder head in the axial direction of the crankshaft, the secondary air valve includes an air inlet part which is disposed in a position opposite to the outer lateral surface of the cylinder head in the axial direction of the crankshaft, the bracket includes a support part configured to support a pipe constituting an upstream part of the air introduction passage, the upstream part being located upstream of the secondary air valve, a grip member is attached to the support part of the bracket, and the upstream part includes: a downstream end coupled to the air inlet part of the secondary air valve and an intermediate part which is supported to the support part of the bracket with use of the grip member.

2. The secondary air introduction device as claimed in claim 1, wherein the secondary air valve includes an elastic valve body having a plate shape, and the secondary air valve is arranged such that a thickness direction of the valve body corresponds to the axial direction of the crankshaft.

3. The secondary air introduction device as claimed in claim 1, wherein the secondary air valve is disposed on one side in the axial direction of the crankshaft with respect to a power transmission member configured to transmit power to a valve mechanism of the engine, and an exhaust port of the engine is provided on the other side with respect to the power transmission member.

4. The secondary air introduction device as claimed in claim 1, wherein an exhaust pipe of the engine extends on the other side of the cylinder head in the axial direction of the crankshaft.

5. The secondary air introduction device as claimed in claim 1, wherein the secondary air valve is configured to be attached to the cylinder head through a plug member configured to close a passage defined inside the cylinder head.

6. The secondary air introduction device as claimed in claim 1, wherein a pipe constituting a downstream part of the air introduction passage and connecting the secondary air valve with the exhaust passage is made of a metal material.

7. The secondary air introduction device as claimed in claim 1, wherein a pipe constituting a downstream part of the air introduction passage and connecting the secondary air valve with the exhaust passage extends in the axial direction of the crankshaft in an area lower than a top part of a cylinder head cover.

8. The secondary air introduction device as claimed in claim 1, wherein the grip member is detachably attached to a through-hole defined in the support part.

* * * * *